US005407320A

United States Patent [19]

Hutchinson

[11] Patent Number: 5,407,320

[45] Date of Patent: Apr. 18, 1995

[54] TURBINE COWLING HAVING COOLING AIR GAP

[75] Inventor: David Hutchinson, Derby, England

[73] Assignee: Rolls-Royce, PLC, London, England

[21] Appl. No.: 122,422

[22] PCT Filed: Jan. 7, 1992

[86] PCT No.: PCT/GB92/00024

§ 371 Date: Sep. 23, 1993

§ 102(e) Date: Sep. 23, 1993

[87] PCT Pub. No.: WO92/17686

PCT Pub. Date: Oct. 15, 1992

[30] Foreign Application Priority Data

Apr. 2, 1991 [GB] United Kingdom ..... 9106810

[51] Int. Cl.[6] ..... F04D 31/00

[52] U.S. Cl. ..... 415/116; 415/115

[58] Field of Search ..... 415/115, 116

[56] References Cited

U.S. PATENT DOCUMENTS 2,445,661 7/1948 Constant et al. ..... 415/115
2,639,579 3/1953 Willgoos ..... 415/115
2,759,700 8/1956 Wheatley ..... 415/115
2,783,965 3/1957 Birmann ..... 415/115
5,100,291 3/1992 Glover ..... 415/116
5,152,666 10/1992 Stripinis et al. ..... 415/116

FOREIGN PATENT DOCUMENTS 2108586 5/1983 United Kingdom ..... 415/116

*Primary Examiner*—Edward K. Look
*Assistant Examiner*—Mark Sgantzos
*Attorney, Agent, or Firm*—Cushman, Darby Cushman

[57] ABSTRACT

A turbine casing having temperature requirements that vary along the casing and which is at least partially enclosed by a cowling so that a gap is defined between the casing and cowling through which a flow of cooling air may be directed in use, the gap having a magnitude that varies along the casing relative to the temperature requirements of the casing to thereby vary the local velocity of the flow, the cowling being provided with channel shaped portions defining the variations in the gap between the cowling and the turbine casing.

4 Claims, 1 Drawing Sheet

TURBINE COWLING HAVING COOLING AIR GAP

BACKGROUND OF THE INVENTION

This invention relates to a turbine casing and is particularly concerned with the cooling of such a casing.

The turbine of a gas turbine engine typically comprises a circular cross-section casing which encloses axially alternate annular arrays of aerofoil blades and vanes. During the operation of the engine, hot gases exhausted from the engine combustion equipment are passed through the turbine in order to provide rotation of the annular arrays of turbine blades.

DESCRIPTION OF THE PRIOR ART

Since the gases are very hot, they naturally provide some degree of heating of the turbine casing. In order to permit the casing to withstand this heating, it is usual to manufacture the casing from a high temperature resistant alloy. However, notwithstanding this, the casing can reach undesirably high temperatures, thereby making it necessary to provide cooling. One way of achieving such cooling is by the provision of cooling air manifolds around the exterior surface of the casing. Apertures in the manifolds direct a flow of cooling air on to the casing surface.

While such cooling air manifolds can be effective in providing casing cooling, they tend to be complicated and costly to produce. Moreover, their positioning adjacent the casing has to be accurate to ensure that the desired degree of cooling is achieved.

SUMMARY OF THE INVENTION

It is an object of the present invention to provide a turbine casing cooling system which is simple.

According to the present invention, a turbine casing is at least partially enclosed by a cowling so that a gap is defined between them for the flow of a cooling air, the magnitude of said gap varying in proportion to the local cooling requirements of said turbine casing so that local velocity variations in each flow of cooling air is facilitated.

BRIEF DESCRIPTION OF THE DRAWINGS

The present invention will now be described, by way of example, with reference to the accompanying drawings in which.

DETAILED DESCRIPTION OF THE INVENTION

Figure 1:
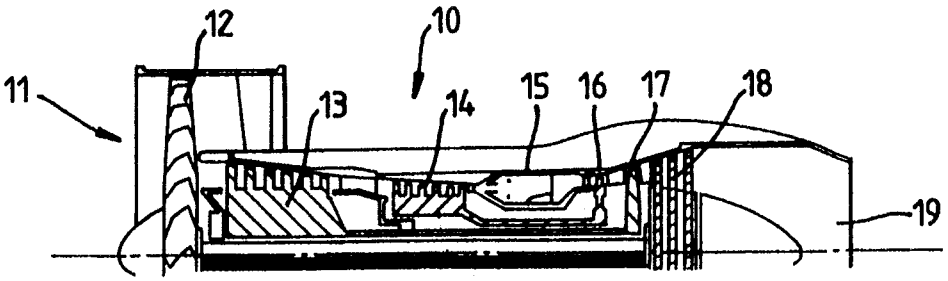
FIG. 1 is a sectioned side view of the upper half of a ducted fan gas turbine engine have a turbine casing in accordance with the present invention.

With reference to FIG. 1, a ducted fan gas turbine engine generally indicated at 10 comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in the conventional manner so that air entering the intake 11 is accelerated by the fan 12 to produce two air flows: a first air flow into the intermediate pressure compressor 13 and a second flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
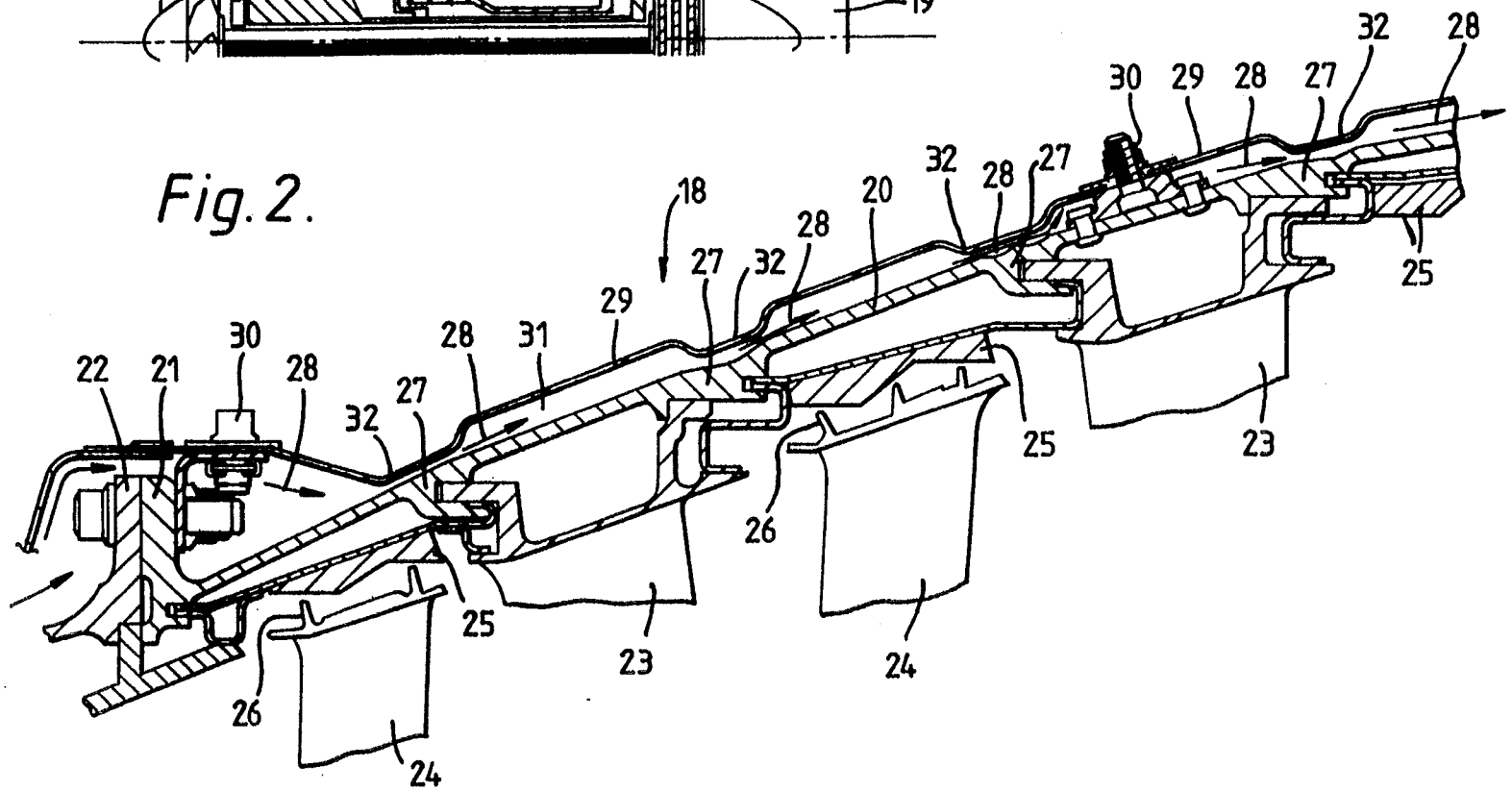
FIG. 2 is a sectioned side view, on an enlarged scale, of a portion of the turbine casing of the ducted fan gas turbine engine shown in FIG. 1.

A portion of the casing 20 of the low pressure turbine 18 can be seen in greater detail if reference is now made to FIG. 2. The casing 20 is of generally frustoconical configuration and is provided with an annular flange 21 at its upstream end for attachment to a corresponding flange 22 provided on the downstream end of the casing of the intermediate pressure turbine 17. A further flange (not shown) is provided on the downstream end of the casing 20 to provide support for the nozzle 19.

The casing 20 contains axially alternate annular arrays stator aerofoil vanes 23 and rotor aerofoil blades 24. The rotor aerofoil blades are mounted in the conventional manner on the peripheries of discs contained within the casing 20. Annular shrouds 25 are mounted on the internal surface of the casing 20 to cooperate with the radially outer tips 26 of the rotor aerofoil blades 24 so that a gas seal is defined between them.

The edges of the annular shrouds 25 are located in slots provided in thickened support regions 27 which are formed integrally with the casing 20. The thickened support regions 27 additionally provide support for the radially outer extents of the stator vanes 23.

The turbine casing 20 inevitably gets hot during normal engine operation and requires a certain degree of cooling in order to ensure that its temperature remains within acceptable limits. That cooling is provided by a flow of cooling air over the exterior surface of the casing 20 as indicated by the arrows 28. The air is derived from the low pressure compressor 12 and is constrained to flow in a generally axial direction by an annular cowling 29 which surrounds the casing 20.

The cowling 29 is attached to the casing 20 by a series of bolt and bracket assemblies 30. It generally follows the configuration of the casing 20 so that a radial gap 31 of generally constant magnitude is defined between cowling 29 and the casing 20 for the cooling air flow 28. However, those regions of the cowling 29 which surround the thickened casing portion 27 are deformed so that they define circumferentially extending channels 32. The channels 32 serve to provide local reductions in the magnitude of the radial gap 31 adjacent the thickened casing portions 27. This ensures that as the cooling air flow 28 passes through the gap 31 its velocity locally increases through the narrow portions of the gap 31 to provide enhanced cooling of the thickened casing portions 27. Consequently the cooling air flow 28 is able to provide variable cooling of the turbine casing 20: those thickened casing portions 27 which require a greater degree of cooling being provided with a higher velocity cooling air flow than the remainder.

The turbine casing 20 is therefore cooled in a uniform manner and this helps to ensure that it maintains its configuration during engine operation. This in turn means that the radial clearances between the tips 26 of the rotor aerofoil blades 24 and the annular shroud 25 can be maintained at smaller values than would be the case if the casing 20 did not maintain its configuration. Such reduced clearances ensure greater overall turbine efficiency.

A further benefit from the provision of the cowling channels 32 is that they enhance the stiffness of the cowling 29. The cowling 29 can be therefore formed from thinner, and therefore lighter, material than would otherwise be the case.

Although the present invention has been described with reference to a turbine casing 20 provided with a cowling 29 which is configured so as to ensure a cooling air flow velocity increase in the regions of the thickened casing portions 27, it will be appreciated that other configurations could be used if so desired. Such alternative configurations would of course be determined by the cooling requirements of the casing.

I claim:

1. A turbine casing having temperature requirements that vary along said casing and which is at least partially enclosed by a cowling so that a gap is defined between said casing and said cowling to define a gap through which a flow of cooling air may be directed in use, said gap having a magnitude that varies along said casing relative to said temperature requirements of said casing to thereby vary the local velocity of said flow, said cowling being provided with channel shaped portions defining said variations in said gap between said cowling and said turbine casing.

2. A turbine casing as claimed in claim 1 characterised in that said casing (20) is provided with regions (27) which are of greater thickness than the other regions thereof, the gap (31) between said cowling (29) and said regions of greater thickness (27) being of lesser magnitude than that between said cowling (29) and said other regions of said casing (20) so as to provide a local increase in the velocity of said cooling air flow adjacent said regions (27) of increased casing thickness, said gap (31) between said cowling (29) and said other regions of said casing (20) being of substantially constant magnitude.

3. A turbine casing as claimed in claim 2 characterised in that said casing regions (27) of increased thickness provide support for shroud members (25) and stator vanes (23) located within said turbine casing (20).

4. A turbine casing as claimed in claim 1 characterised in that said channel-shaped portions (32) are additionally so configured as to provide enhanced cowling (29) stiffness.

* * * * *